United States Patent [19]

DeVault et al.

[11] 3,981,262

[45] Sept. 21, 1976

[54] WATER JET PROPULSION APPARATUS

[75] Inventors: Robert DeVault, Malibu; Ralph Maloof, Woodland Hills, both of Calif.

[73] Assignee: Sidewinder Marine, Inc., Redding, Calif.

[22] Filed: Jan. 22, 1971

[21] Appl. No.: 108,946

[52] U.S. Cl. ..... 115/12 R; 60/221; 115/14

[51] Int. Cl.[2] ..... B63H 11/10

[58] Field of Search ..... 115/11, 12 R, 14, 16; 60/221

[56] References Cited

UNITED STATES PATENTS

| | | | |
|---|---|---|---|
| 3,040,694 | 6/1962 | Cochran | 115/12 R |
| 3,089,454 | 5/1963 | Chronic | 115/12 R |
| 3,109,407 | 11/1963 | Dorst | 115/14 |
| 3,204,598 | 9/1965 | Sharp | 115/34 |
| 3,405,526 | 10/1968 | Aschauer | 115/16 X |
| 3,561,392 | 2/1971 | Baez | 115/12 R |
| 3,669,057 | 6/1972 | Shimanckas | 115/34 |

FOREIGN PATENTS OR APPLICATIONS

| | | |
|---|---|---|
| 1,281,286 | 12/1961 | France |

*Primary Examiner*—Trygve M. Blix
*Assistant Examiner*—Barry L. Kelmachter
*Attorney, Agent, or Firm*—Limbach, Limbach & Sutton

[57] ABSTRACT

A water jet propulsion apparatus is disclosed having a water conveying conduit with a pump therein and a high efficiency substantially triangular opening flush with the bottom of the craft with a small angle ramp wall inclined upwardly beginning at the apex of the triangle and substantially vertical side walls from the sides of the triangle to the ramp wall. At the opening the sides of the triangle bow outwardly from a true triangle toward the base of the triangle which has a rounded edge. The pump shaft is supported in the conduit in a housing and with the impeller on the end of the shaft and having blades supported on a hub forming passageways within a constant outside diameter but a hub diameter increasing from the inlet side of the impeller to the outlet side. The outlet opening is in the form of two vertical substantially rectangular openings with a steering vane located therebetween and with the outside housing walls forming the openings converging aftwardly toward the steering vane. The vane is hollow and houses a reversal cup support arm rotatably mounted therewithin and connected to a reversal cup movable via said arm from a position below the aft end of the vane to a position aft of the vane to deflect the outlet stream downwardly, sidewardly and forward for reverse drive.

5 Claims, 13 Drawing Figures

FIG. 1
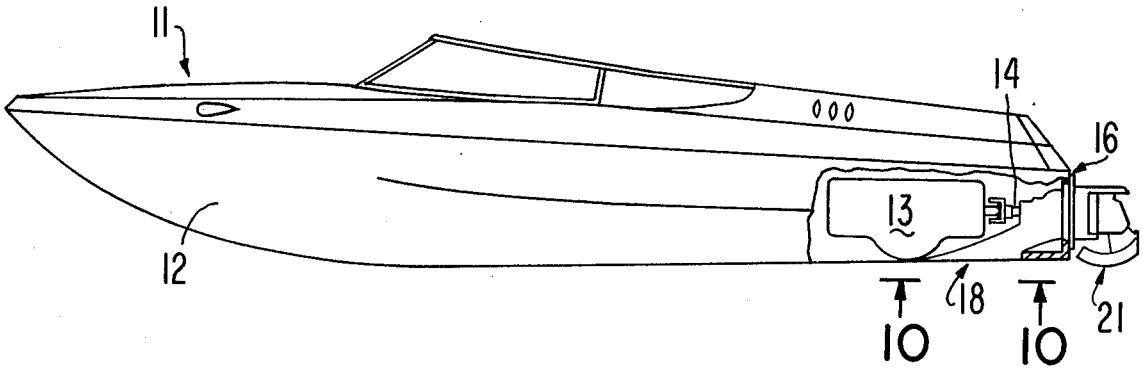
FIG. 9
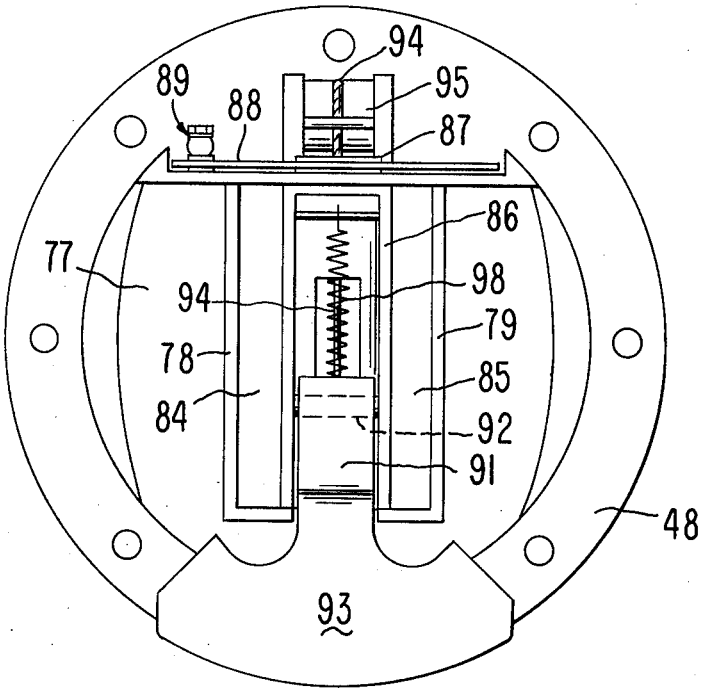
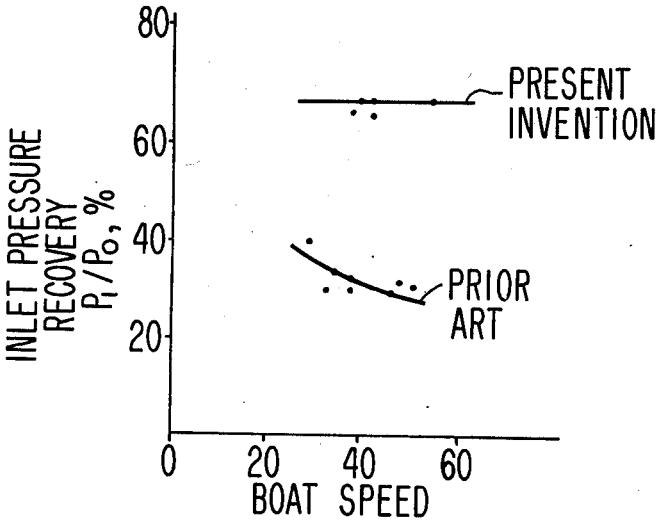
FIG. 13
INVENTORS
ROBERT T. DE VAULT
RALPH P. MALOOF
BY Fimbach, Fimbach and Sutton
ATTORNEYS

INVENTORS
ROBERT T. DE VAULT
RALPH P. MALOOF

BY Timbach, Timbach and Sutton
ATTORNEYS

INVENTORS
ROBERT T. DE VAULT
RALPH P. MALOOF

BY Fimbach, Fimbach and Sutton
ATTORNEYS

FIG. 5
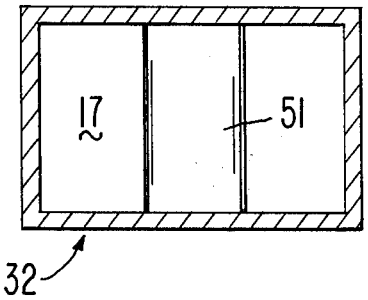
FIG. 6
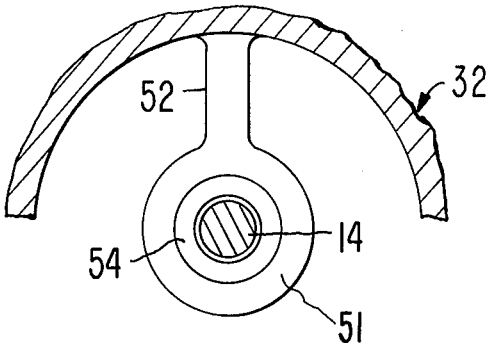
FIG. 7
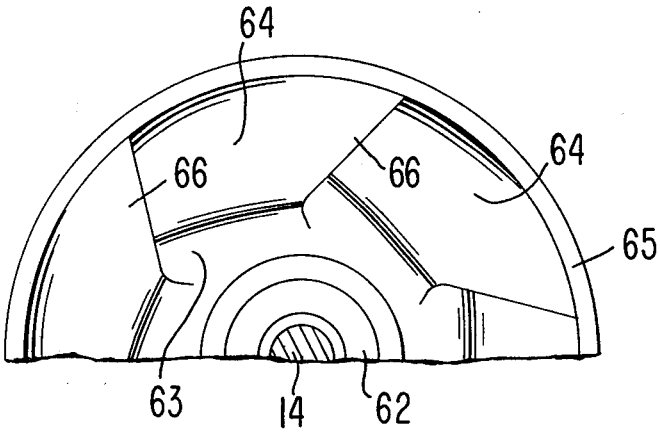
FIG. 8
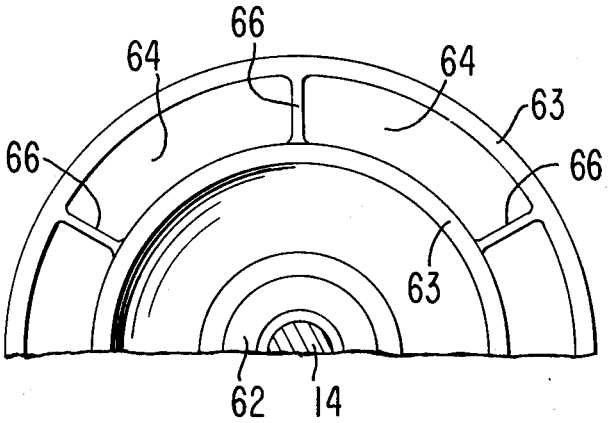
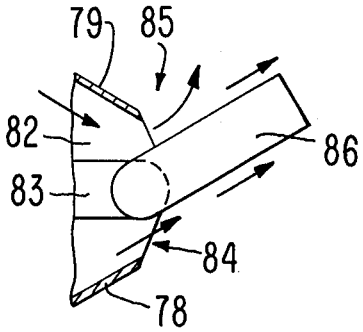
FIG. 12
INVENTORS
ROBERT T. DEVAULT
RALPH P. MALOOF
BY
Limbach, Limbach and Sutton
ATTORNEYS

WATER JET PROPULSION APPARATUS

The present invention relates in general to boat drives and, more particularly, to a water jet propulsion apparatus for boats.

Various different water jet propulsion constructions have been proposed and certain of these are commercially available. All of these constructions suffer from a very inefficient inlet system for delivering water to the pump.

Additionally, the drive systems incorporate complex steering mechanisms difficult to manufacture and maintain, many of which require auxiliary steering members for controlling a reversed jet stream when the jet stream is directed from its normal path for slowing down or reversing the craft motion.

The object of the present invention is to provide a new, efficient jet propulsion apparatus.

In accordance with one aspect of the present invention, the jet propulsion apparatus includes a highly efficient inlet structure for delivering water to the pump in the water-conveying conduit. The inlet structure includes a substantially triangular inlet opening flush with the bottom of the boat with the apex of the triangle aligned toward the fore end of the craft. The conduit includes a ramp wall inclined at a very small angle, less than 20°, with respect to the keel of the boat, and a pair of substantially vertical side walls extending upwardly to the ramp wall from the sides of the opening.

This opening enables utilization of the pressure rise in the pump system due to water flow thereinto by reason of forward boat velocity. Additionally, this inlet design enables diversion of the hull boundary layer and at the same time permits the formation of vortices to pull high energy flow into the inlet.

In accordance with another aspect of the present invention, the pump drive shaft is supported in a housing in the water conduit both preventing damage to the shaft from objects entering the conduit and avoiding the possibility that elongate members, such as ropes and lines, will wrap around the shaft.

In accordance with still another aspect of the present invention, the impeller in the water pump includes blades which define passages having constant outside diameter but a hub diameter that increases from the inlet side to the outlet side of the impeller. This construction permits achievement of the desired jet velocity in a single stage pump without enlarging the size of the pump housing.

In accordance with another aspect of the present invention, the jet propulsion apparatus combines a novel steering assembly with an outlet manifold defining two vertical substantially rectangular outlet openings between manifold side walls and a central dividing member. A steering vane is rotatably mounted at the aft end of the dividing member and means are provided for moving the vane from side to side across the openings to steer the craft from side to side. The outside side walls of the manifold converge aftwardly toward the central dividing member. This construction provides an efficiently operating jet stream. Additionally, by reason of the converging side walls, the efficiency of the stream is maintained during turning operation, and both of the outlet openings can contribute to the turning process when the vane is turned to one side.

In accordance with still another aspect of the present invention, a reversal mechanism is provided supported from an arm located within the steering vane for movement of a reversal cup from a position below the steering vane and out of the jet stream to a position behind the steering vane in the jet stream for deflection of the jet stream downwardly and forwardly. Since this reversal member is mounted on the steering vane, it turns with the steering vane and no additional steering structure is required for the reversal operation.

Other objects and advantages of this invention will become apparent when reading the following description and referring to the accompanying drawing in which similar characters of reference represent corresponding parts in each of the several views.

In the drawings:

FIG. 1 is a side elevational view, partially broken away, illustrating the present invention.

FIG. 5 is an elevational sectional view of a portion of the structure shown in FIG. 2 taken along line 5—5 in the direction of the arrows.

FIG. 6 is an elevational sectional view of another portion of the structure shown in FIG. 2 taken along line 6—6 in the direction of the arrows.

FIG. 7 is an elevational sectional view of the inlet side of the impeller shown in FIG. 2 taken along line 7—7 in the direction of the arrows.

FIG. 8 is an elevational sectional view of the outlet side of the impeller shown in FIG. 2 taken along line 8—8 in the direction of the arrows.

FIG. 9 is an elevational rear view of the structure shown in FIG. 2 taken along line 9—9 in the direction of the arrows.

FIG. 12 is a schematic view illustrating the operation of the steering mechanism.

FIG. 13 is a graph showing inlet pressure recovery versus boat speed for an inlet constructed in accordance with the prior art and for an inlet in accordance with the present invention.

Figure 2:
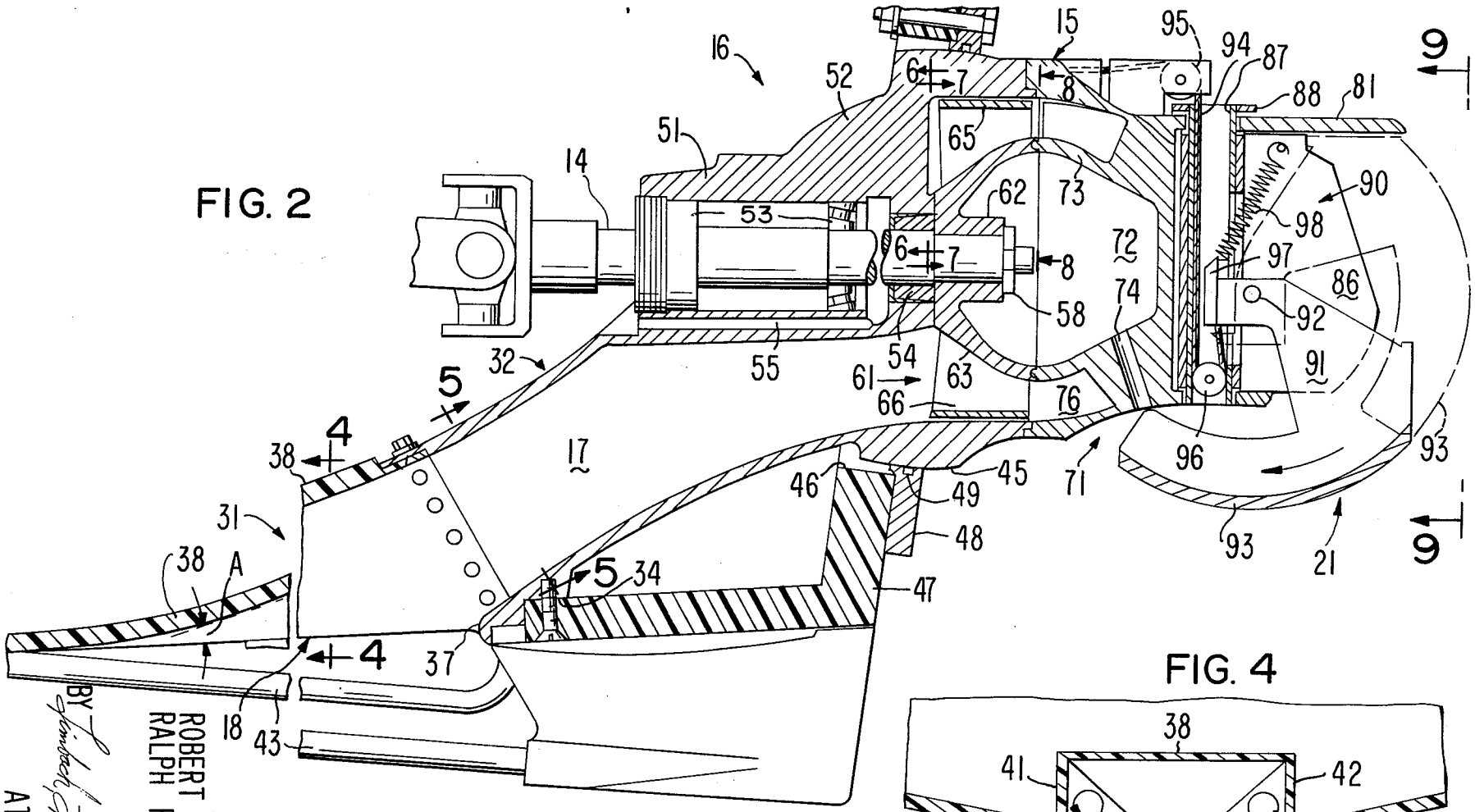
FIG. 2 is a foreshortened side elevational sectional view of a portion of the structure shown in FIG. 1.

Referring now to the drawing, there is shown a water craft 11 having a hull 12, typically made of fiberglass, and having a prime mover 13, here illustrated as an internal combustion engine, connected via a drive shaft 14 to a pump 15 in the water jet propulsion system 16. The propulsion system includes a water conveying conduit 17 for carrying water from an inlet opening 18 flush with the bottom of the hull 12, through the pump 15 and out an outlet opening 19 as a high velocity jet stream for propelling the craft.

A steering and reversing mechanism 21 is provided for manipulating the jet stream at the outlet opening 19 for steering and reversing the craft.

Referring now to FIG. 2, the conduit 17 includes an inlet region at the inlet opening 18, a portion extending from the inlet region to the pump region, and a pump outlet region. The inlet region includes an initial conduit portion 31, such as of fiberglass and formed when the boat is molded, and this conduit portion is connected, such as by screws 33, to a cast housing 32, such as of aluminum, for the pump 15 and forming the remainder of the conduit. The lower end of housing 32 defines the aft end of the inlet opening 18 and also includes a flange 34 engaging the hull at one edge of the inlet opening 18.

Figure 11:
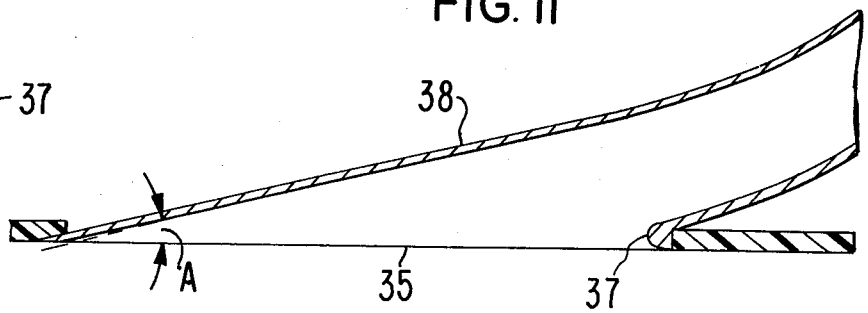
FIG. 11 is a schematic side elevational sectional view showing the entire inlet outline omited by foreshortening FIG. 2.
Figure 10:
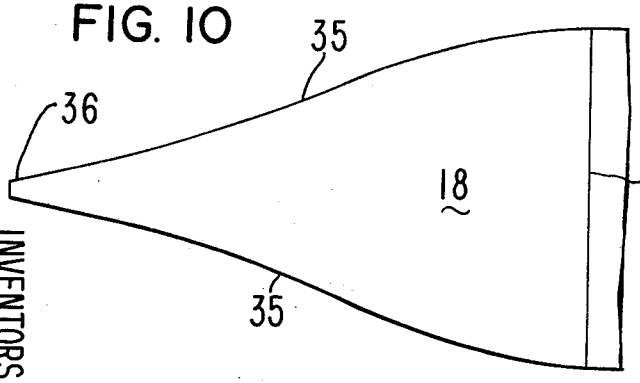
FIG. 10 is a bottom view of a portion of the structure shown in FIG. 1 taken along line 10—10 in the direction of the arrows.

As shown in FIGS. 10 and 11, the inlet opening 18 is generally triangular in shape and defined by sides 35 extending from the apex 36 aligned toward the forward end of the boat to the base 37 defined by housing 32. The sides 35 of the triangular inlet opening do not converge to an actual point at the apex, and in the direction of the base of the triangular, the sides bow slightly outwardly from a true triangle and meet the base 37 substantially perpendicular thereto.

Figure 4:
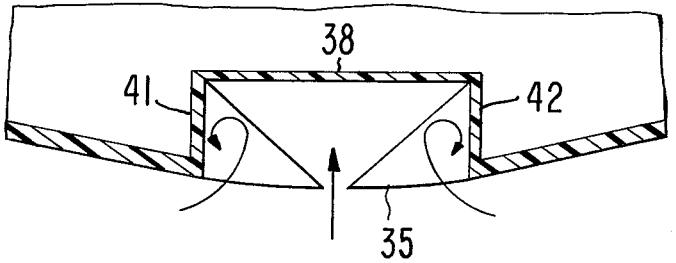
FIG. 4 is an elevational sectional view of a portion of the structure shown in FIG. 2 taken along line 4—4 in the direction of the arrows.
Figure 3:
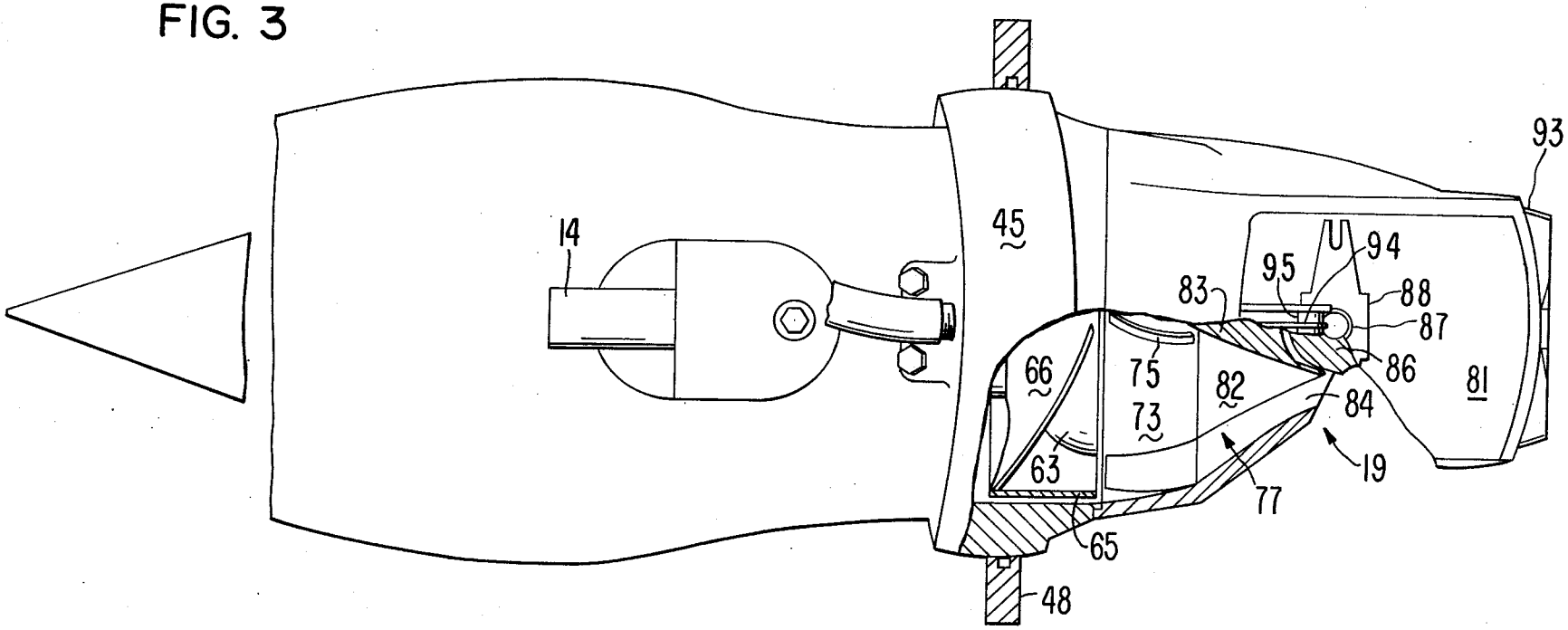
FIG. 3 is a top view, partially broken away, of the structure shown in FIG. 2.

The initial conduit portion 31 includes a ramp wall 38 curving slightly upwardly and gradually at the apex of the inlet opening 19 and progressing to the main housing 33 at a very small angle A with respect to the keel of the craft. Typically, this angle is less than about 20° and inlet conduits with angles of between 4° and 10° work well. Side walls 41 and 42 extend substantially vertically upwardly from the bottom of the boat to the ramp wall 38 so that the transverse cross section of the initial conduit portion 31 is substantially rectangular and open on the bottom as shown in FIG. 4. The edge of the opening at the base 37 of the triangle is rounded thereby avoiding large flow losses.

A plurality of guard bars 43 are provided secured to the bottom of the hull to prevent large objects from entering the inlet opening.

The main housing 32 of the conduit 17 includes a portion 45 positioned within a circular opening 46 in the transom 47 of the craft, and a ring 48 having an opening with a diameter slightly larger than the spherical surface 45 is bolted to the transom and provided with a sealing gasket 49 creating a seal with the spherical surface 45.

A shaft housing 51 is provided in the main housing 32 extending into the conduit and supported by a narrow septum 52 extending almost to the pump impeller for completely enclosing the drive shaft 14 up to connection to the impeller of the pump. The drive shaft 14 is mounted in the shaft housing 51 in sealed bearings 53. A packing gland 54 is provided at the inner end of the housing adjacent the end of the drive shaft, and seal draining channel 55 drains any leakage to the bilge.

The pump impeller 61 mounted on the end of the drive shaft with a lock nut 58 is provided with a hub 62 having an outwardly flared surface 63 in the downstream direction with a plurality of blades 64 extending outwardly from the flared surface 63 to an outer hollow cylindrical support member or shroud 65. From the inlet side of the impeller 61 to the outlet thereof, the flared surface 63, the blades 64 and the support member 65 define a plurality of fluid passageways having a constant outside diameter but an increasing inside diameter.

A stator and steering support housing 71 is secured to the main housing at the aft end thereof around the impeller, such as by bolts. This housing 71 includes a generally cup-shaped cavity defined by an outwardly flared wall mating with the flared surface 63 of the impeller and provided with a pressure relief passage 74 for draining any fluid and preventing pressure build up.

The stator portion of this housing includes a plurality of straightening blades 75 which define passage 76 terminating in an outlet maniflod 77 defined by outside side walls 78 and 79 and top and bottom walls 81 and 82. A central substantially vertical dividing member 83 divides the outlet manifold 77 into two vertically oriented substantially rectangular outlet openings 84 and 85.

A steering slab or vane 86 is rotatably supported vertically at the end of the outlet housing 71 via a hollow pin rotated by means of an actuating arm 88 positioned above the top wall 81. A control cable 89 is connected to the actuating arm 88 for turning the steering vane to turn the craft.

The side walls 78 and 79 converge toward the steering vane 86 to converge the jet rearwardly and slightly toward the steering vane.

The steering vane 86 includes a hollowed out cavity 90 from its aft end to the mounting pin 87 to receive a curved, reversal cup support arm 91 rotatably mounted in the cavity via a pin 92. A jet stream reversal cup 93 is provided on the end of the support arm 91 and moved from a position below the outlet openings 84 and 85 via a wire cable 94 extending over a pulley 95 rotatably mounted at the top of the hollow pin 87, down through the pin and around a pulley 96 rotatably mounted at the bottom of the pin 87 and back up to an actuating bar 97 connected on the end of the reversal cup support arm 91. A spring 98 is connected from the actuating bar to a pin near the top of the cavity in the steering vane 86 for holding the reversal cup in the lower position out of the fluid jet stream. The raised position for the reversal cup 93 is shown in phantom in FIG. 2.

In operation of the water jet propulsion apparatus in accordance with the present invention, water enters the inlet 18 and flows and/or is pumped to the pump 15. By reason of the very small ramp angle in the initial portion of the inlet conduit and the triangular shape of the opening, a highly efficient inlet structure is provided. The small ramp angle prevents flow separation from the hull that would cause high turbulence and pressure losses in the inlet. Additionally, the side walls of the triangular opening which extend vertically upwardly to the ramp wall and bow out toward the base of the triangular opening enable diversion of the hull boundary layer and at the same time permit the formation of vortices in the inlet to pull high energy flow in the inlet as shown in FIG. 4.

Comparative tests have been run on a model of the present invention for comparison with an existing Model 12JB-B jet drive manufactured by Berkeley Pump Company, Berkeley, Calif. and having a rectangular opening and using a relatively large angle of about 30° for the ramp wall of the inlet. Curves showing the efficiency of these inlet systems are given in FIG. 13.

An additional advantage of the inlet structure having a small angled ramp wall is the possible location for the prime mover which can be located over the initial inclined portion of the inlet and thereby positioned further back in the boat than in other commercially available pumping systems.

From the inlet opening, water flows to the impeller around the drive shaft housing which avoids the possibility that elongate elements such as pieces of rope might wrap around the impeller drive shaft and jam the drive system.

By utilization of an impeller that maintains a constant outside diameter with an inside diameter increasing from the inlet to the outlet and in combination with the high efficiency inlet opening system, a single stage pump, rather than a multistage pump or one requiring an enlarged housing, is achieved. In the outlet portion of the jet propulsion apparatus, the jet stream is directed out of the two outlet openings converging toward the steering vane. The water craft is steered by turning the steering vane to one side or the other as shown in FIG. 12. With the present invention, the water stream directed out of the opening on the side to which the vane is steered impinges more directly on the vane tending to turn the craft thereby, while at the same time the converging stream from the other outlet opening passes generally along the steering vane rather than straight rearward from the craft thereby also enhancing the steering capability.

With the reversal cup mounted on this steering vane, the stream can be reversed for reversal of the craft and without the necessity for additional steering mechanisms to steer the boat when driving in reverse direction.

What is claimed is:

1. A water jet propulsion apparatus for water craft comprising:

a water-conveying conduit having an inlet opening substantially flush with the bottom of the craft and an outlet opening at the aft end of the craft and a pump within said conduit for discharging water as a propulsion jet through said outlet opening, said inlet opening substantially in the shape of an isosceles triangle with the base of the triangle substantially straight and transverse of the length of the craft and with the apex of the triangle aligned toward the fore end of the craft, said conduit including a ramp wall extending upwardly aft from the apex of said inlet opening at an angle of less that 20°.

2. A water jet propulsion apparatus for water craft comprising:

a water-conveying conduit having an inlet opening substantially flush with the bottom of the craft and an outlet opening at the aft end of the craft and a pump within said conduit for discharging water as a propulsion jet through said outlet opening, said inlet opening substantially in the shape of an isosceles triangle with the base of the triangle substantially straight and transverse of the length of the craft and with the apex of the triangle aligned toward the fore end of the craft, said conduit including:

a ramp wall extending upwardly aft at a small angle from the apex of said inlet opening and side walls extending substantially vertically upwardly from the sides of said triangular opening and forming a corner with said ramp wall.

3. A water jet propulsion apparatus for water craft comprising:

a water-conveying conduit having an inlet opening substantially flush with the bottom of the craft and and outlet opening at the aft end of the craft and a pump within said conduit for discharging water as a propulsion jet through said outlet opening, said inlet opening substantially in the shape of an isosceles triangle with the base of the triangle substantially straight and transverse of the length of the craft and with the apex of the triangle aligned toward the fore end of the craft, said conduit including:

a ramp wall extending upwardly aft at a small angle from the apex of said inlet opening and side walls extending substantially vertically upwardly from the sides of said triangle opening and forming a corner with said ramp wall, the sides of said triangle forming said inlet opening bowing outwardly from a triangle toward the base of the triangle.

4. A molded fiberglass water craft for a water jet propulsion apparatus including a water-conveying conduit with a pump within the conduit for discharging water as a propulsion jet through the outlet end of the conduit comprising:

a fiberglass hull including a bottom and a transom with an opening in said transom for the outlet portion of the propulsion apparatus and an inlet conduit portion molded in the bottom of said hull defining an inlet opening substantially flush with the bottom of the hull and extending to the water conveying conduit of the water propulsion apparatus, said inlet opening being substantially in the shape of an isosceles triangle with the base of the triangle substantially straight and transverse to the length of the craft and with the apex of the triangle aligned toward the fore end of the craft, said conduit portion including a ramp wall extending upwardly aft from the apex of said inlet opening at an angle of less than 20°.

5. A molded fiberglass water craft for a water jet propulsion apparatus including a water-conveying conduit with a pump within the conduit for discharging water as a propulsion jet through the outlet end of the conduit comprising:

a fiberglass hull including a bottom and a transom with an opening in said transom for the outlet portion of the propulsion apparatus and an inlet conduit portion molded in the bottom of said hull defining an inlet opening substantially flush with the bottom of the hull and extending to the water-conveying conduit of the water propulsion apparatus, said inlet opening being substantially in the shape of an isosceles triangle with the base of the triangle substantially straight and transverse to the length of the craft and with the apex of the triangle aligned toward the fore end of the craft, said conduit portion including:

a ramp wall extending upwardly aft at a small angle from the apex of said inlet opening and said walls extending substantially vertically upwardly from the sides of said triangular opening to said ramp wall.

* * * * *